US011254552B2

(12) United States Patent
Eggert et al.

(10) Patent No.: US 11,254,552 B2
(45) Date of Patent: Feb. 22, 2022

(54) FLOOR JACK LIFT ARM

(71) Applicant: Snap-on Incorporated, Kenosha, WI (US)

(72) Inventors: Daniel M. Eggert, Kenosha, WI (US); Christopher D. Thompson, Franklin, WI (US); Jonathan I. Andersen, Mount Pleasant, WI (US)

(73) Assignee: Snap-on Incorporated, Kenosha, WI (US)

( * ) Notice: Subject to any disclaimer, the term of this patent is extended or adjusted under 35 U.S.C. 154(b) by 68 days.

(21) Appl. No.: 16/720,945

(22) Filed: Dec. 19, 2019

(65) Prior Publication Data

US 2021/0188608 A1 Jun. 24, 2021

(51) Int. Cl.
*B66F 13/00* (2006.01)
*B66F 5/00* (2006.01)

(52) U.S. Cl.
CPC ..... *B66F 13/00* (2013.01); *B66F 5/00* (2013.01)

(58) Field of Classification Search
CPC ..... B66F 3/12; B66F 5/00; B66F 5/02; B66F 5/025; B66F 5/04; B66F 13/00; B66F 13/12
USPC ..... 254/2 R, 4 B, 7 R, 8 R; D34/31
See application file for complete search history.

(56) References Cited

U.S. PATENT DOCUMENTS 6,435,477 B2 * 8/2002 Brunnhoelzl ..... B66F 5/04 254/8 B
6,902,147 B2 6/2005 Hung
7,334,774 B1 2/2008 Lin
10,569,998 B2 * 2/2020 Coccaro ..... B66F 5/04
2001/0035522 A1 11/2001 Brunnhoelzl
2005/0035337 A1 * 2/2005 Hung ..... B66F 5/04 254/8 B
2005/0218384 A1 10/2005 Hernandez et al.
2006/0157678 A1 * 7/2006 Lin ..... B66F 5/04 254/8 B
2014/0326934 A1 11/2014 Zhou et al.
2016/0368542 A1 * 12/2016 Taylor ..... B66F 7/0666
2019/0210848 A1 7/2019 Coccaro

FOREIGN PATENT DOCUMENTS

CN 201080418 Y 7/2008

OTHER PUBLICATIONS https://www.garagejournal.com/forum/showthread.php?t=199817 [Accessed May 4, 2021],"The Garage Journal," 12 pages.
Combined Search Report for corresponding United Kingdom Application No. GB2018978.3 dated May 7, 2021, 6 pages.
Examination Report No. 1 for corresponding Australian Application No. 2020281066 dated Jun. 22, 2021, 12 pages.
Taiwan Office Action for corresponding Taiwan Application No. 11020646490 dated Jul. 8, 2021, 8 pages.

* cited by examiner

*Primary Examiner* — Seahee Hong
(74) *Attorney, Agent, or Firm* — Seyfarth Shaw LLP

(57) ABSTRACT

A lift arm of a floor jack is composed of a number of components made from metal bar stock. The lift arm is adapted to transfer power and motion from a power unit to a saddle, which is adapted to be placed at a lift point of the vehicle, thereby applying pressure to the lift point and raising the vehicle.

19 Claims, 8 Drawing Sheets

FLOOR JACK LIFT ARM

TECHNICAL FIELD OF THE INVENTION

The present invention relates generally to garage floor jacks. More particularly, the present invention relates to a lift arm for a garage floor jack mechanism.

BACKGROUND OF THE INVENTION

Garage floor jacks are used to lift a vehicle from the ground. An operator positions the floor jack underneath a lift point and raises the vehicle at that point. Floor jacks are typically hydraulically powered and can be operated manually or automated means, and have become important to the automotive repair industry.

Floor jacks are required to withstand significant amounts of weight, such as that of a vehicle. To provide the strength and stability necessary to support such weights, the internal components of the jack must be sturdy and capable of withstanding significant forces, in multiple directions, during actuation of the lifting and releasing mechanism of the jack. Lift arms typically are coupled to a saddle that is adapted to engage a lift point of the vehicle. The lift arm receives power and motion from a power unit (i.e., hydraulically operated piston(s) or other suitable lift mechanisms), which is transferred to the saddle via the lift arm, thereby applying lifting force to the lift point and raising the vehicle.

Traditional lift arms are made from a casting. Casting requires machining (e.g., fettling) to make the finished part. Due to the complexity of the lift arms, however, machining is a long, expensive process. In addition, castings typically have a poorer surface finish and lower material strength and dimensional accuracy compared to components machined from metal bar stock.

SUMMARY OF THE INVENTION

The present invention broadly relates to a lift arm of a floor jack. The lift arm includes a majority of components made from metal bar stock of a suitable material, such as steel or aluminum. Using metal bar stock allows the lift arm to have a superior surface finish and increased material strength, minimized faults, and dimensional accuracy compared to traditional floor jack lift arms manufactured using a casting process. In addition, machining is simplified, cost effective, and more time efficient, compared to using a casting process.

According to an embodiment, the present invention broadly comprises a lift arm of a floor jack. The lift arm includes first and second side plates having fastener apertures, and a block, first and second block plates, and pins disposed between the first and second side plates to couple the assembly together.

According to another embodiment, the present invention broadly comprises a lift arm of a floor jack. The lift arm includes a first side plate including a first recess and a second side plate including a second recess, where the first and second side plates include fastener apertures and are adapted to couple with a floor jack base, a first stiffener plate and a first washer disposed between the first side plate and the floor jack base, a second stiffener plate and a second washer disposed between the second side plate and the floor jack base, a block disposed between the first and second side plates, a first block plate disposed between the block and the first side plate, where the first block plate forms a first slot with the first recess, a first spacer plate disposed between the first block plate and the first side plate, a second block plate disposed between the block and the second side plate, where the second block plate forms a second slot with the second recess, a second spacer plate disposed between the second block plate and the second side plate, and pins disposed between the first and second side plates. The fastener apertures are adapted to receive threaded fasteners. The block, the first and second block plates, the first and second spacer plates, and the pins are coupled to the first and second side plates using threaded fasteners.

According to another embodiment, the present invention broadly comprises a lift arm of a floor jack that includes a first side plate including a first recess and a second side plate including a second recess, the first and second side plated including fastener apertures, a block disposed between the first and second side plates, a first block plate disposed between the block and the first side plate, the first block plate forming a first slot with the first recess, a second block plate disposed between the block and the second side plate, the second block plate forming a second slot with the second recess, and pins disposed between the first and second side plates to couple the assembly together. The fastener apertures are adapted to receive threaded fasteners. The block, the first and second block plates, and the pins are coupled to the first and second side plates using the threaded fasteners.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION OF THE EMBODIMENTS

Figure 1:
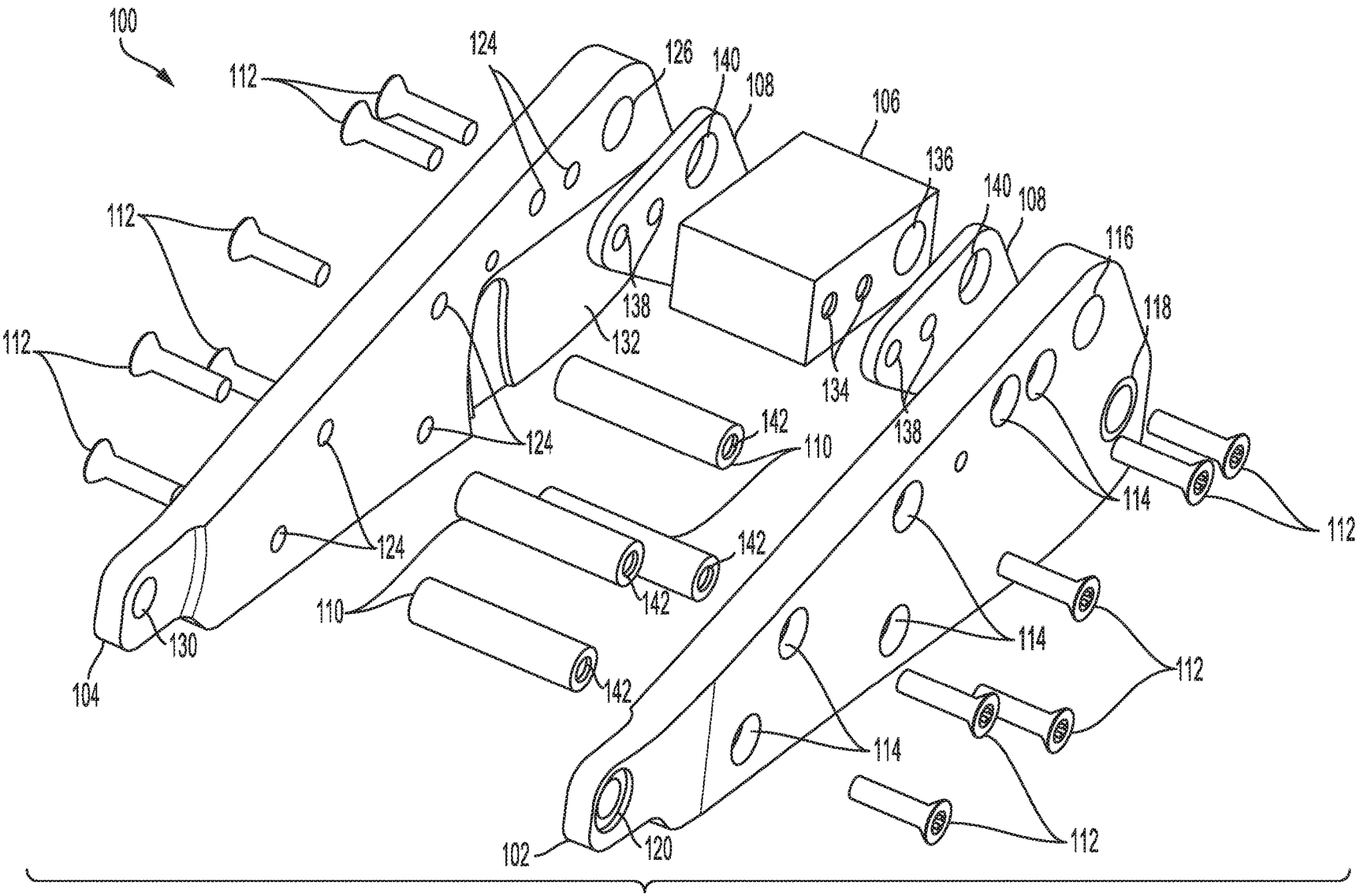
FIG. 1 is a disassembled, exploded perspective view of a lift arm according to an embodiment of the present invention.
Figure 2:
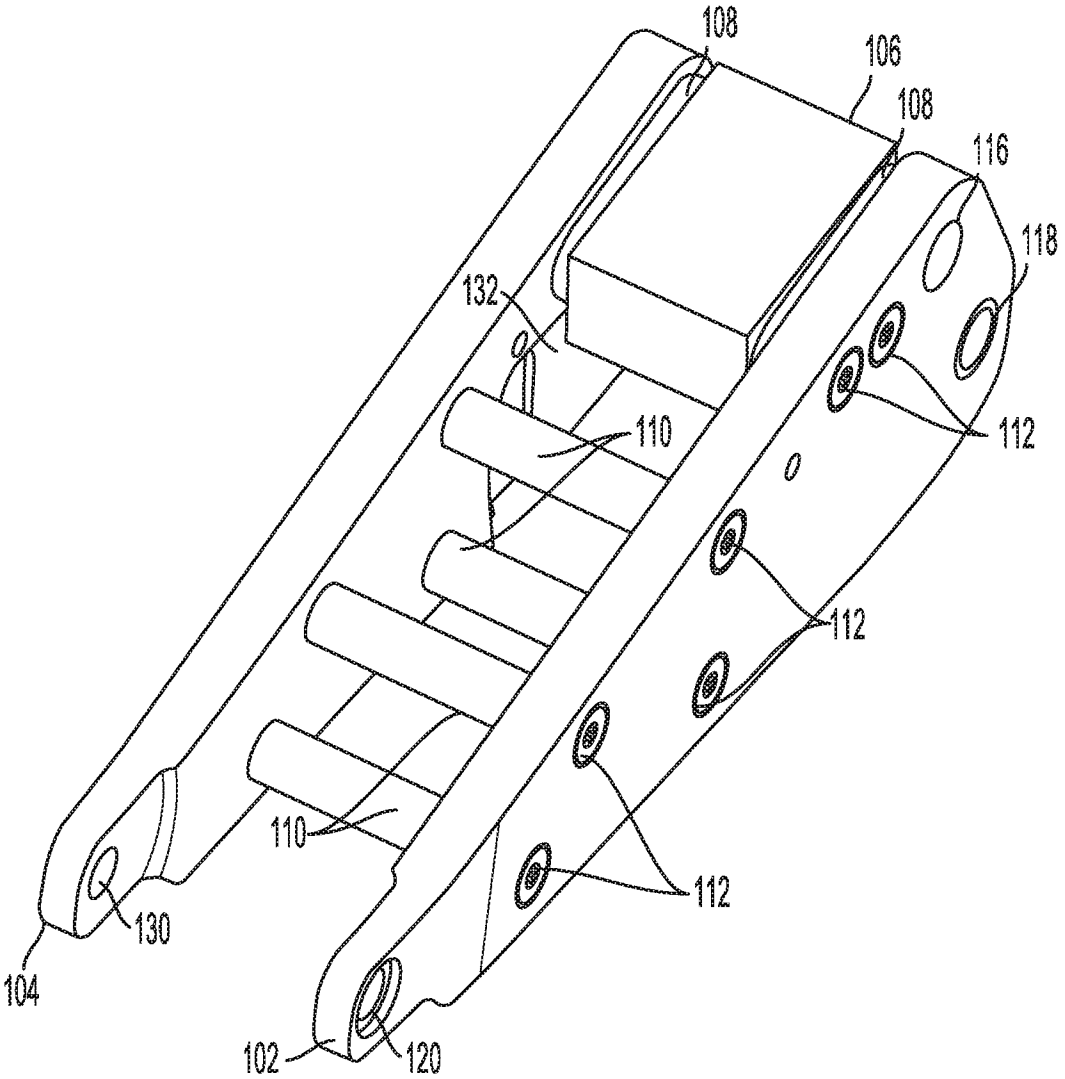
FIG. 2 is an assembled, perspective view of the lift arm of FIG. 1.
Figure 3:
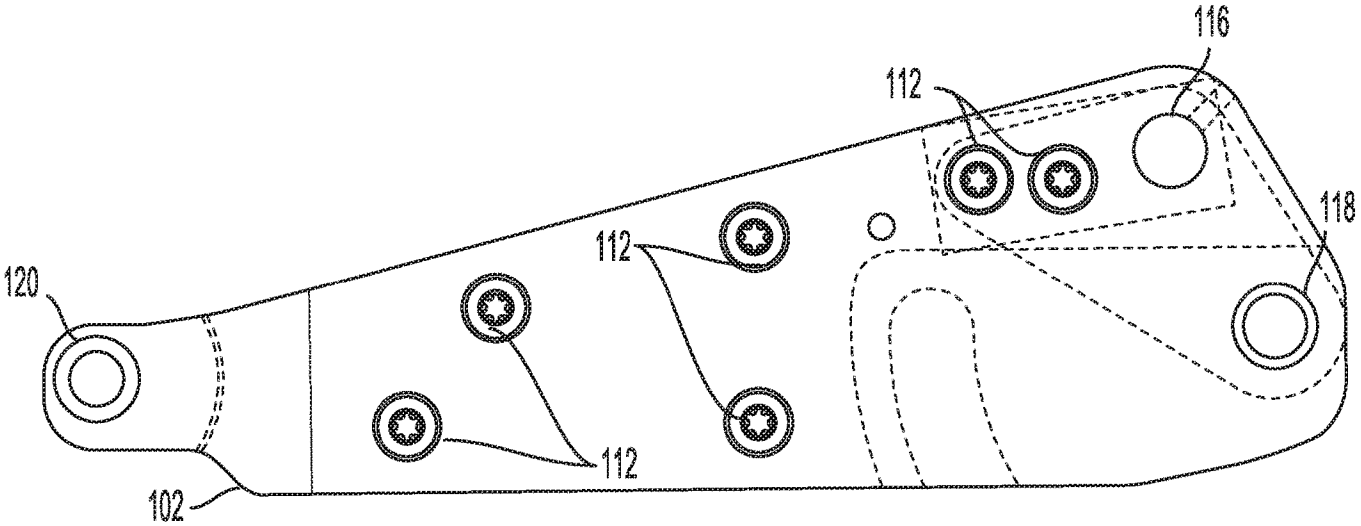
FIG. 3 is a side plan view of the lift arm of FIG. 1.
Figure 4:
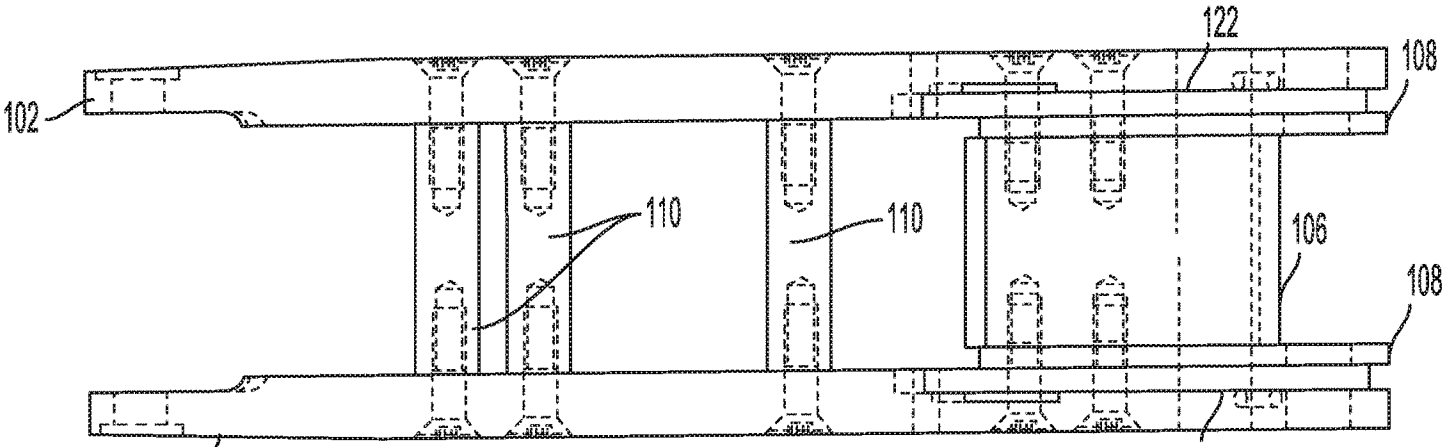
FIG. 4 is a bottom plan view of the lift arm of FIG. 1.

While the present invention is susceptible of embodiments in many different forms, there is shown in the drawings, and will herein be described in detail, embodiments, including a preferred embodiment, of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly relates to a lift arm of a garage floor jack. The lift arm is one component in a multi-component mechanism used to lift vehicles. Rather than use a complicated cast component, the lift arm of the present invention is composed of several components made from machined metal bar stock. This allows for a stronger design and simplifies necessary machining compared to current solutions.

Figure 5:
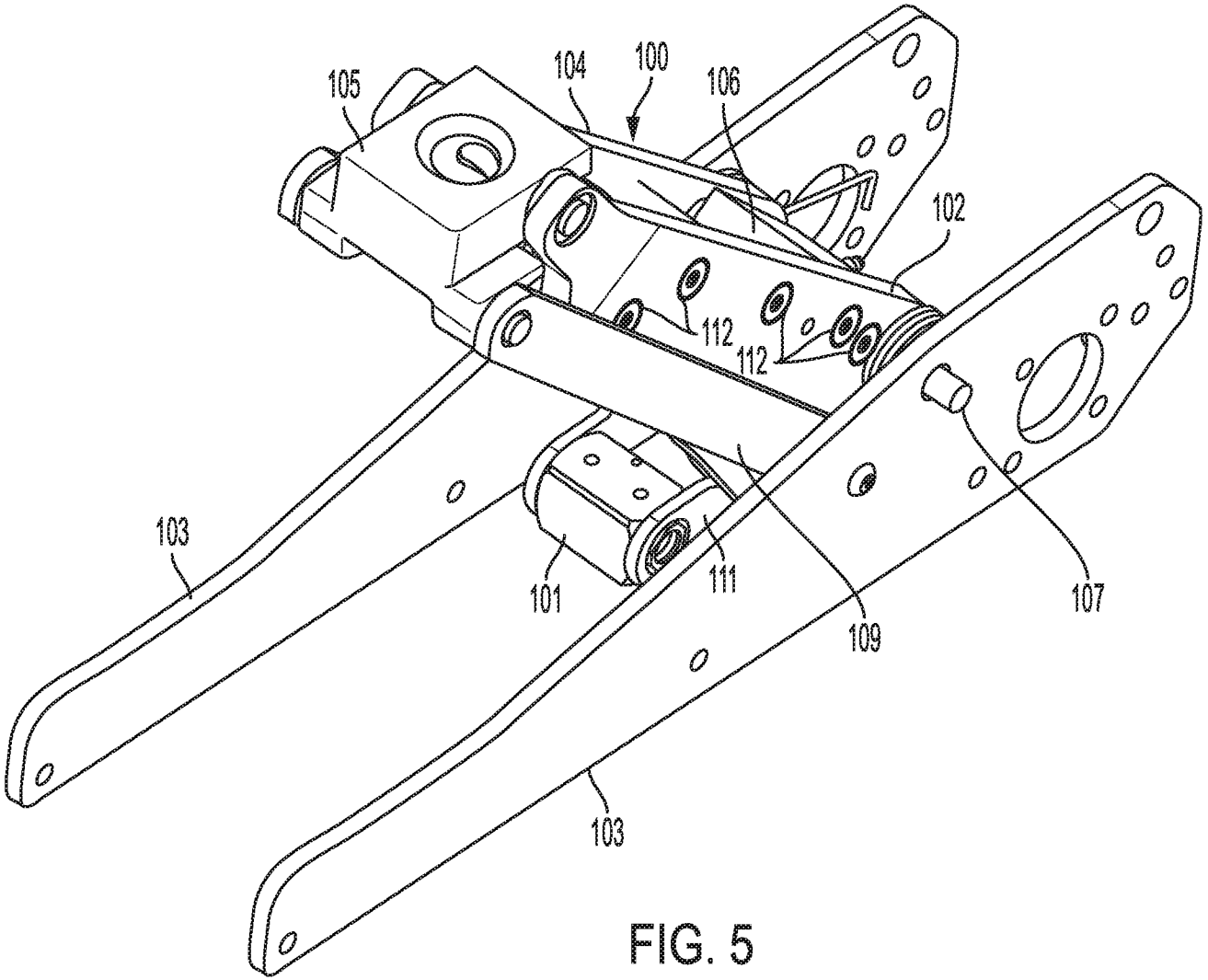
FIG. 5 is a perspective view of the lift arm of FIG. 1 coupled to a floor jack according to an embodiment of the present invention.
Figure 6:
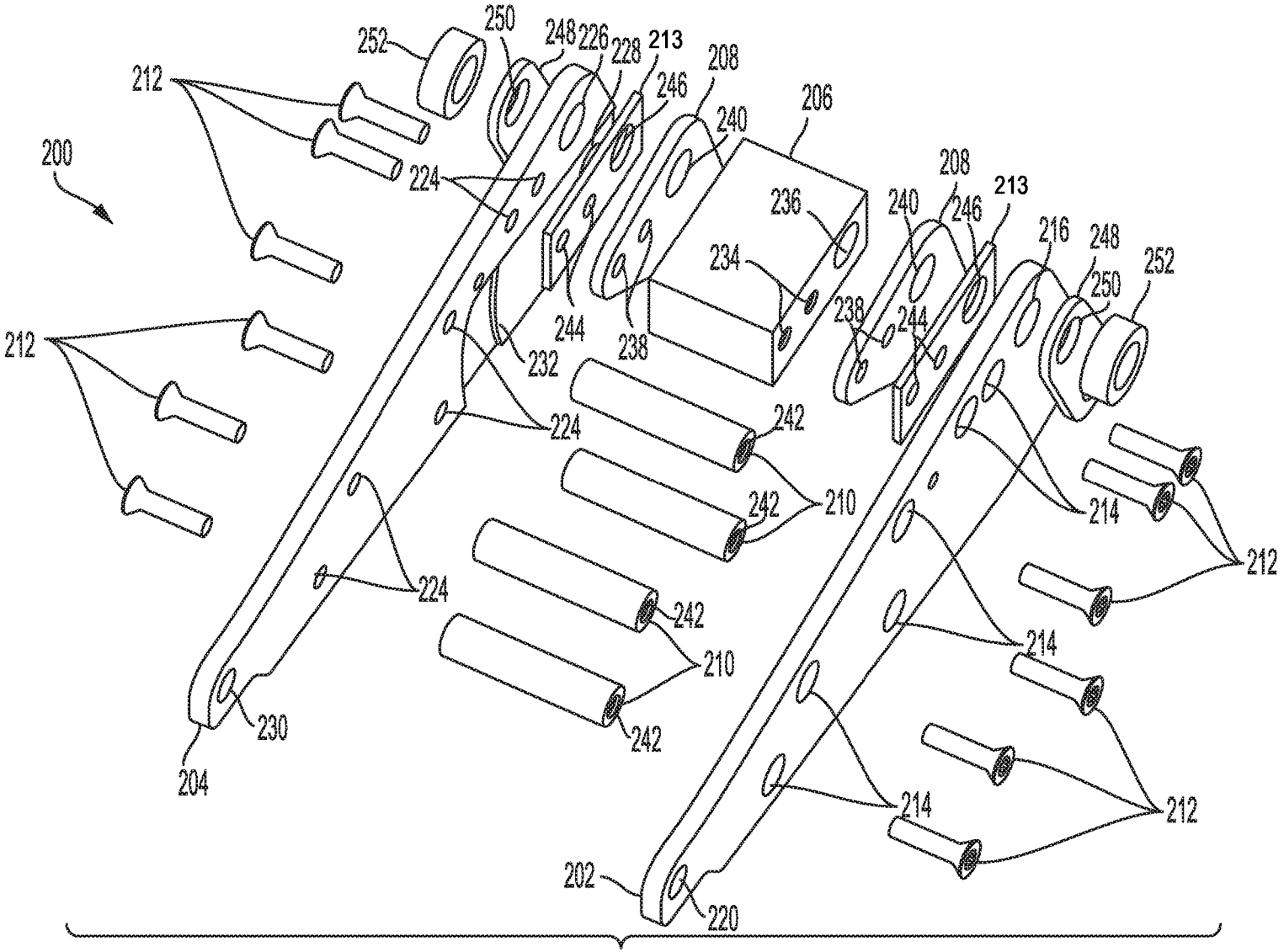
FIG. 6 is a disassembled, exploded perspective view of a lift arm according to another embodiment of the present invention.
Figure 7:
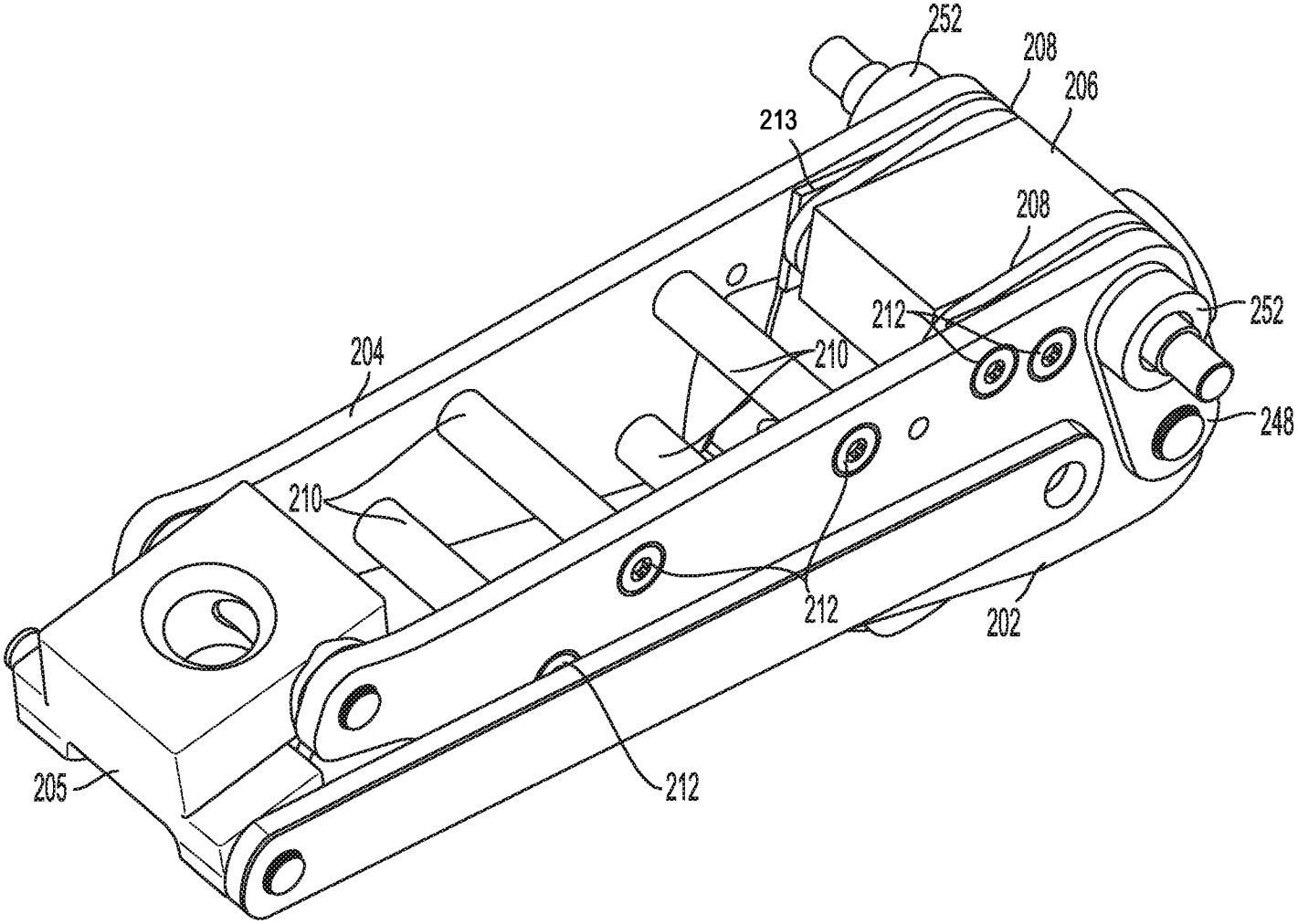
FIG. 7 is an assembled perspective view of the lift arm of FIG. 6.
Figure 8:
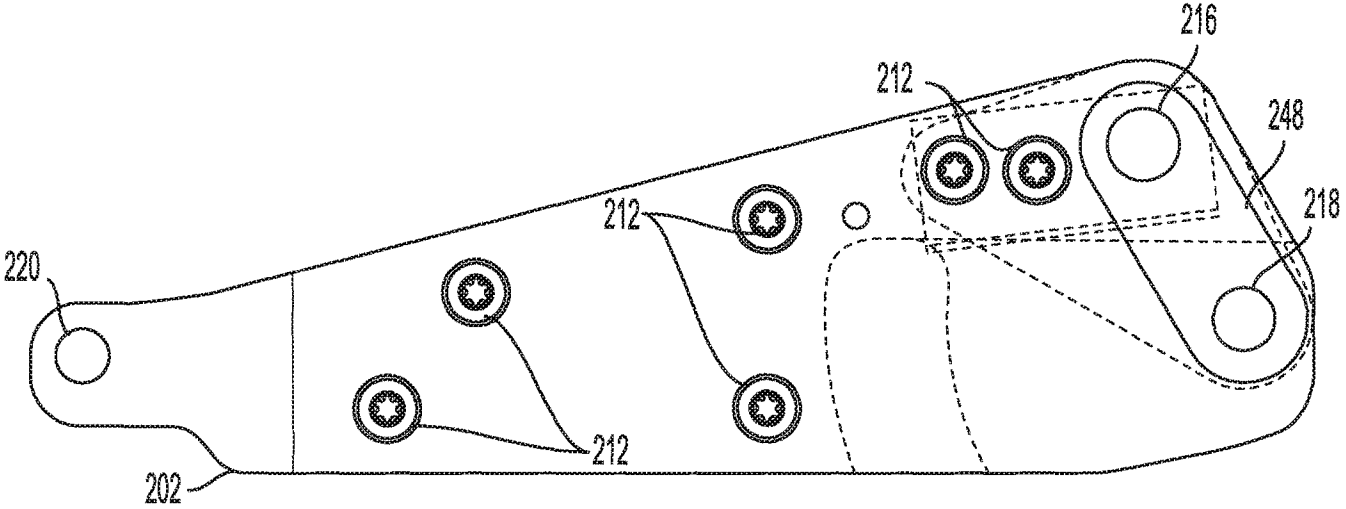
FIG. 8 is a side plan view of the lift arm of FIG. 6.
Figure 9:
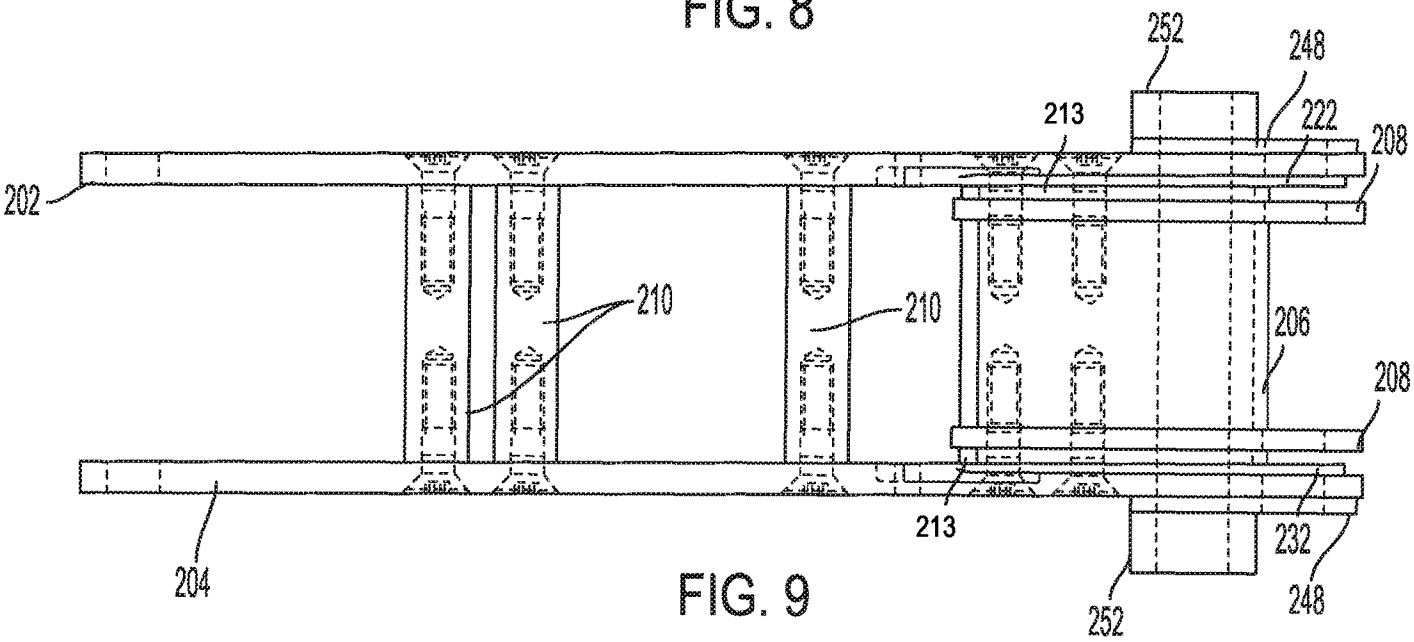
FIG. 9 is a bottom plan view of the lift arm of FIG. 6.

Referring to FIGS. 1 through 5, a lifting arm 100 includes first 102 and second 104 side plates, a block 106, block plates 108, and pins 110 (also referred to as stand-off pins). The lifting arm 100 can be one component in a conventional multi-component mechanism to lift vehicles. As shown in FIG. 5, in an embodiment, a handle (not shown) is operably coupled to the lifting arm 100 via a lifting block 101, which is rotatably coupled at a first end to side plates 103 of a floor jack base via a pivot pin 107. The lifting arm 100 moves relative to the side plates 103 of the floor jack base in response to motion of the handle. A saddle 105 is coupled to a second end of the lifting arm 100 and coupled to the side plates 103 via side arms 109. The saddle 105 moves with the lifting arm 100 in response to motion of the handle, thereby allowing the saddle 105 to engage and raise a vehicle. It will be appreciated that while the present invention is broadly discussed as being used for lifting a vehicle, this is for exemplification purposes only, as the present invention can be used to lift or otherwise move any object that can be lifted with floor jacks.

To assemble the lifting arm 100, the block 106, block plates 108, and stand-off pins 110 are disposed between the first 102 and second 104 side plates. These components can be coupled to one another using fasteners 112. The fastener 112 may be, for example, a threaded bolt, cotter pin, shear pin, or the like. Alternately, these components can be coupled to one another by welding.

The first side plate 102 can be machined from flat stock material, such as, for example, steel or aluminum. The first side plate 102 can include a number of fastener apertures 114 adapted to receive the fasteners 112. The fastener apertures 114 can be countersunk or counterbored. The first side plate 102 can include apertures 116, 118, and 120. The apertures 116 can be adapted to receive a fastener or elongated shaft, such as, for example, the pivot pin 107 to rotatably couple the lift arm 100 to the side plates 103 of the floor jack base. The apertures 118 can be adapted to receive a fastener or elongated shaft to rotatably couple the lift arm 100 to the lifting block 101. The apertures 120 can be adapted to receive a fastener or elongated shaft to rotatably couple the lift arm 100 to the saddle 105. The first side plate 102 can include a recess 122. The recess 122 forms a slot with one of the block plates 108. The slot can slidably engage with side arms 111 of the lifting block 101 to restrict lateral movement of the lift arm 100 relative to the floor jack base.

In an embodiment, the first 102 and second 104 side plates can be identical or mirror images of one another. Accordingly, the second side plate 104 can include similar features as those described above for the first side plate 102. For example, the second side plate 104 can also be machined from flat stock material, such as, for example, steel or aluminum. The second side plate 104 can include a number of fastener apertures 124 adapted to receive the fasteners 112. The fastener apertures 124 can be countersunk or counterbored. The second side plate 104 can include apertures 126, 128, and 130, each adapted to respectively receive fasteners or elongated shafts to rotatably couple the lift arm 100 to the side plates 103 of the floor jack base, the lifting block 101, and the saddle 105. The second side plate 104 can include a recess 132. The recess 132 forms a slot with one of the block plates 108. The slot can slidably engage with the side arms 111 of the lifting block 101 to restrict lateral movement of the lift arm 100 relative to the floor jack base.

The block 106 is disposed between the first 102 and second 104 side plates and can be machined from flat stock metal, such as, for example, steel or aluminum. The block 106 can include apertures 134. The apertures 134 can be adapted to respectively threadably engage the fasteners 112 to couple the first 102 and second 104 side plates to the block 106. The block 106 can include an aperture 136 that is adapted to be axially aligned with the apertures 116 and 126 and is adapted to receive the pivot pin 107 adapted to rotatably couple the lift arm 100 to the side plates 103 of the floor jack base.

The block plates 108 are disposed between the first 102 and second 104 side plates and the block 106. The block plates 108 can be machined from flat stock metal, such as, for example, steel or aluminum. Each of the block plates 108 can include apertures 138 that correspond with the apertures 134 of the block 106. Each of the block plates 108 can also include apertures 140 that correspond with apertures 116 and 118 of the first side plate 102 and apertures 126 and 128 of the second side plate 104.

Any number of the stand-off pins 110 (also referred to as pins) can be disposed between the first 102 and second 104 side plates. The stand-off pins 110 can be machined from flat or round stock metal, such as, for example, steel or aluminum. Although illustrated as having a relatively circular cross-section, the stand-off pins 110 can have other suitable cross-sections, such as, for example, square or rectangular. The stand-off pins 110 can include apertures 142 adapted to threadably couple with the fasteners 112.

Figure 10:
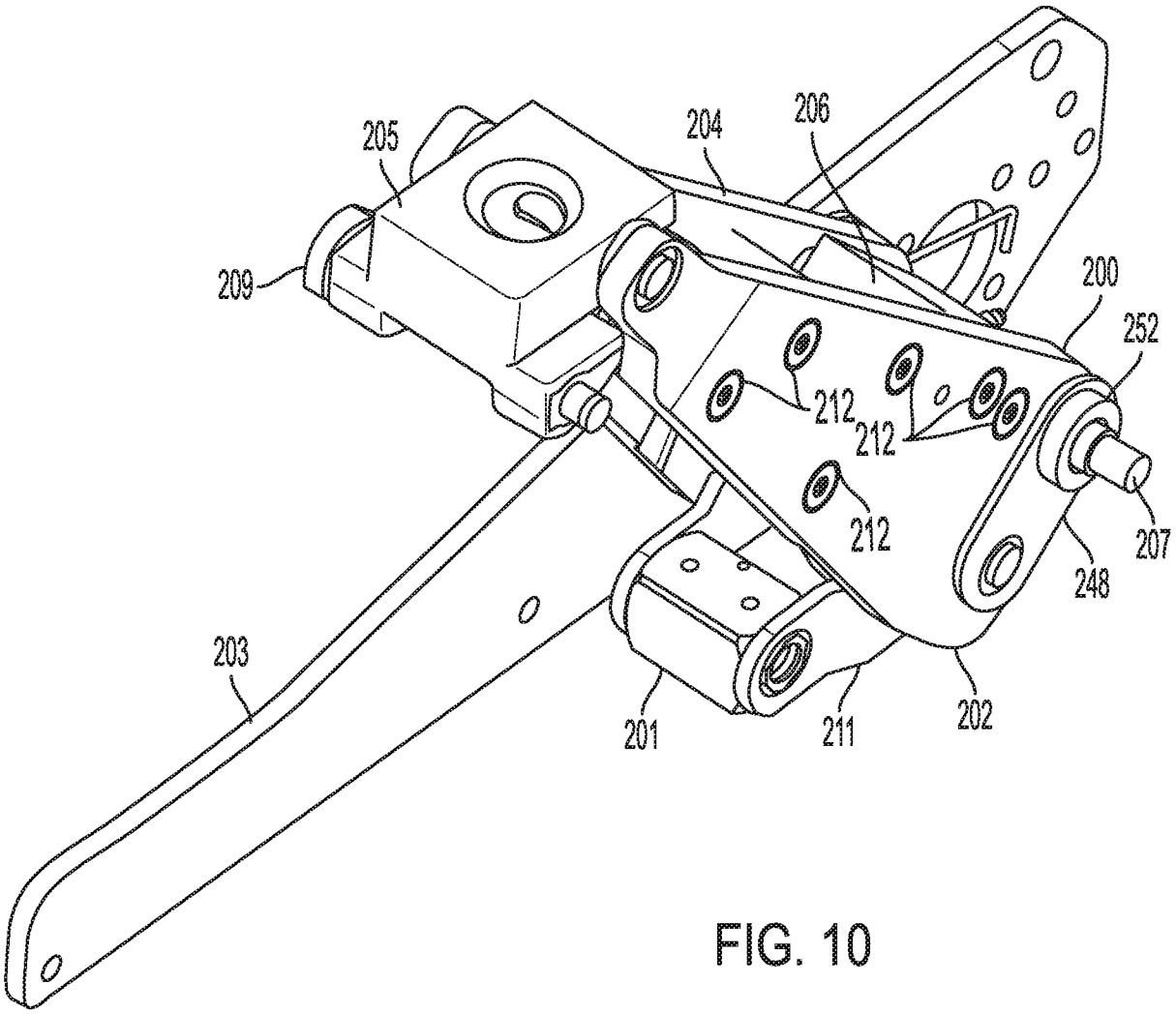
FIG. 10 is a partial broken perspective view of the lift arm of FIG. 6 coupled to a floor jack according to an embodiment of the present invention.

Referring to FIGS. 6 through 10, a lift arm 200 according to another embodiment includes first 202 and second 204 side plates, a block 206, block plates 208, pins 210 (also referred to as stand-off pins), and spacer plates 213. The lifting arm 200 can be one link in a conventional multi-link mechanism to lift vehicles. As shown in FIG. 10, in an embodiment, a handle (not shown) is operably coupled to the lifting arm 200 via a lifting block 201, which is rotatably coupled at a first end to side plates 203 of a floor jack base via a pivot pin 207. The lifting arm 200 moves relative to the side plates 203 of the floor jack base in response to motion of the handle. A saddle 205 is coupled to a second end of the lifting arm 100 and coupled to the side plates 203 via side arms 209. The saddle 205 moves with the lifting arm 100 in response to motion of the handle, thereby allowing the saddle 205 to engage and raise a vehicle. It will be appreciated that while the present invention is broadly discussed as being used for lifting a vehicle, this is for exemplification purposes only, as the present invention can be used to lift or otherwise move any object that can be lifted with floor jacks.

The lifting arm 200 is similar to the lifting arm 100 described above, except that the lifting arm 200 includes spacer plates 213. To assemble the lifting arm 200, the block 206, block plates 208, pins 210, and spacer plates 213 are disposed between first 202 and second 204 side plates. These components can be coupled to one another using fasteners 212. The fastener 212 may be, for example, a threaded bolt, cotter pin, shear pin, or the like. Alternately, these components can be coupled to one another by welding.

The first side plate 202 can be machined from flat stock material, such as, for example, steel or aluminum. The first side plate 202 can include a number of fastener apertures 214 adapted to receive the fasteners 212. The fastener apertures 214 can be countersunk or counterbored. The first side plate 202 can include apertures 216, 218, and 220. The apertures 216 can be adapted to receive a fastener or elongated shaft, such as, for example, the pivot pin 207 to rotatably couple the lift arm 200 to the side plates 203 of the floor jack base. The apertures 218 can be adapted to receive a fastener or elongated shaft to rotatably couple the lift arm 200 to the lifting block 201. The apertures 220 can be adapted to receive a fastener or elongated shaft to rotatably couple the lift arm 200 to the saddle 205. The first side plate 202 can include a recess 222. The recess 222 forms a slot with one of the block plates 208. The slot can slidably engage with side arms 211 of the lifting block 201 to restrict lateral movement of the lift arm 200 relative to the floor jack base.

The first 202 and second 204 side plates can be identical or mirror images of one another. Accordingly, the second side plate 204 can include similar features as those described above for the first side plate 202. For example, the second side plate 204 can also be machined from flat stock metal, such as, for example, steel or aluminum. The second side plate 204 can include a number of fastener apertures 224 adapted to receive the fasteners 212. The fastener apertures 224 can be countersunk or counterbored. The second side plate 204 can include apertures 226, 228, and 230, each adapted to receive a fastener or elongated shaft to rotatably couple the lift arm 200 to the side plates 203 of the floor jack base, the lifting block 201, and the saddle/saddle base 205, respectively. The second side plate 204 can include a recess 232. The recess 232 forms a slot with one of the block plates 208. The slot can slidably engage with the side arms 211 of the lifting block 201 to restrict lateral movement of the lift arm 200 relative to the floor jack base.

The block 206 is disposed between the first 202 and second 204 side plates and can be machined from flat stock material, such as, for example, steel or aluminum. The block 206 can include apertures 234. The apertures 234 can be adapted to threadably engage the fasteners 212 to couple the first 202 and second 204 side plates to the block 206. The block 206 can include a an aperture 236 that corresponds with the apertures 216 and 226 and is adapted to receive the pivot pin 207 adapted to rotatably couple the lift arm 200 to the floor jack base.

The block plates 208 are disposed between the first 202 and second 204 side plates and the block 206. The block plates 208 can be machined from flat stock metal, such as, for example, steel or aluminum. Each of the block plates 208 can include apertures 238 that correspond with the apertures 234 of the block 206. Each of the block plates 208 can also include apertures 240 that correspond with apertures 216 and 218 of the first side plate 202 and apertures 226 and 228 of the second side plate 204.

Any number of the stand-off pins 210 (also referred to as pins) can be disposed between the first 202 and second 204 side plates. The stand-off pins 210 can be machined from flat or round stock metal, such as, for example, steel or aluminum. Although illustrated as having a relatively circular cross-section, the stand-off pins 210 can have other suitable cross-sections, such as, for example, square or rectangular. The stand-off pins 210 can include apertures 242 adapted to threadably couple with the fasteners 212.

At least one of the spacer plates 213 is disposed between one of the block plates 208 and the first side plate 202, and at least one of the spacer plates 213 is disposed between another of the block plates 208 and the second side plate 204. Accordingly, the thickness of the spacer plates 213 defines a dimension, such as the width, of the slot described above. The spacer plates 213 can include apertures 244 that correspond with the apertures 238 of the block plates 208 and the apertures 234 of the block 206. The spacer plates 213 can also include an aperture 246 that corresponds with the aperture 240 of the block plates 208, the aperture 216 of the first side plate 202, and the aperture 226 of the second side plate 204.

Stiffener plates 248 can be disposed between the side plates 203 of the floor jack base and the first 202 and second 204 side plates, respectively. The stiffener plates 248 can include apertures 250 that correspond with the apertures 216 and 218 of the first side plate 202 and the apertures 226 and 228 of the second side plate 204.

Washers 252 can be disposed between the stiffener plates 248 and the side plates 203 of the floor jack base. The washers 252 can be thrust washers. The washers 252 can be made of a strong, wear resistant material, such as, for example, bronze or other suitable material.

From the foregoing, it can be seen that there has been described an improved lift arm of a floor jack. The lift arm includes a number of components manufactured from bar stock, which provides a superior surface finish and increased material strength and dimensional accuracy over a casting lift arm. Further, the multi-component lift arm requires less machining as compared to the casting lift arm.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A lift arm of a floor jack comprising:

first and second side plates including fastener apertures; and a block, first and second block plates, and pins disposed between the first and second side plates, wherein each of the first and second side plates includes a recess that forms a slot with the respective first and second block plates, and wherein the slots are respectively formed between the first side plate and the first block plate, and the second side plate and the second block plate.

2. The lift arm of claim 1, wherein the first block plate is disposed between the block and the first side plate, and the second block plate is disposed between the block and the second side plate.

3. The lift arm of claim 1, wherein the slots are adapted to engage a floor jack base to restrict lateral movement.

4. The lift arm of claim 1, wherein a dimension of the respective slot of the first and second side plates is defined by a respective thickness of first and second spacer plates disposed between the first and second side plates and the block.

5. The lift arm of claim 1, wherein the fastener apertures are adapted to receive threaded fasteners, and wherein the block, the first and second block plates, and the pins are coupled to the first and second side plates respectively via the threaded fasteners.

6. The lift arm of claim 1, wherein the first and second side plates are adapted to couple to a saddle, a floor jack base, and a power unit.

7. The lift arm of claim 1, wherein one or more of the first and second side plates, the block, the first and second block plates, and the pins are aluminum.

8. The lift arm of claim 1, wherein the first and second side plates, the block, the first and second block plates, and the pins are made from metal bar stock.

9. The lift arm of claim 1, wherein the pins have a substantially circular cross section.

10. The lift arm of claim 1, further comprising first and second spacer plates disposed between the first and second side plates.

11. The lift arm of claim 10, wherein the first block plate and the first spacer plate are disposed between the block and the first side plate, and the second block plate and the second spacer plate are disposed between the block and the second side plate.

12. The lift arm of claim 10, wherein the first and second spacer plates are aluminum.

13. The lift arm of claim 10, wherein the fastener apertures are adapted to receive threaded fasteners, and wherein the block, the first and second block plates, the first and second spacer plates, and the pins are coupled to the first and second side plates via the threaded fasteners.

14. The lift arm of claim 1, further comprising a first stiffener plate disposed between the first side plate and a floor jack base, and a second stiffener plate disposed between the second side plate and the floor jack base.

15. The lift arm of claim 14, further comprising a first washer disposed adjacent the first stiffener plate, and a second washer disposed adjacent the second stiffener plate.

16. A lift arm of a floor jack comprising:

a first side plate including a first recess and a second side plate including a second recess, the first and second side plates including fastener apertures and are adapted to couple with a floor jack base;

a first stiffener plate and a first washer disposed between the first side plate and the floor jack base;

a second stiffener plate and a second washer disposed between the second side plate and the floor jack base;

a block disposed between the first and second side plates;

a first block plate disposed between the block and the first side plate, the first block plate forming a first slot with the first recess;

a first spacer plate disposed between the first block plate and the first side plate;

a second block plate disposed between the block and the second side plate, the second block plate forming a second slot with the second recess;

a second spacer plate disposed between the second block plate and the second side plate; and pins disposed between the first and second side plates, wherein the fastener apertures are adapted to receive threaded fasteners, and the block, the first and second block plates, the first and second spacer plates, and the pins are coupled to the first and second side plates via the threaded fasteners.

17. The lift arm of claim 16, wherein the first and second side plates, the block, the first and second block plates, the first and second spacer plates, and the pins are made from aluminum bar stock.

18. A lift arm of a floor jack comprising:

a first side plate including a first recess and a second side plate including a second recess, the first and second side plates including fastener apertures;

a block disposed between the first and second side plates;

a first block plate disposed between the block and the first side plate, the first block plate forming a first slot with the first recess;

a second block plate disposed between the block and the second side plate, the second block plate forming a second slot with the second recess; and pins disposed between the first and second side plates, wherein the fastener apertures are adapted to receive threaded fasteners, and the block, the first and second block plates, and the pins are coupled to the first and second side plates using the threaded fasteners.

19. The lift arm of claim 18, wherein the first and second side plates, the block, the first and second block plates, and the pins are made from aluminum bar stock.

* * * * *